United States Patent [19]

Ikehara et al.

[11] Patent Number: 4,731,922

[45] Date of Patent: Mar. 22, 1988

[54] APPARATUS FOR CLOSING SLIDE FASTENER CHAINS HAVING SLIDERS

[75] Inventors: Ichiro Ikehara, Toyama; Shingo Hatagishi, Namerikawa; Hiroshi Shirakawa, Uozu, all of Japan

[73] Assignee: Yoshida Kogyo K.K., Tokyo, Japan

[21] Appl. No.: 24,713

[22] Filed: Mar. 11, 1987

[30] Foreign Application Priority Data

Mar. 14, 1986 [JP] Japan ..... 61-37460[U]

[51] Int. Cl.[4] ..... B29D 5/00

[52] U.S. Cl. ..... 29/766; 29/408

[58] Field of Search ..... 29/33.2, 408–410, 29/766–769

[56] References Cited

U.S. PATENT DOCUMENTS 4,238,880 12/1980 Takahashi ..... 29/766
4,292,733 10/1981 Iimura ..... 29/766
4,592,135 6/1986 Kando ..... 29/766
4,685,207 8/1987 Sassa ..... 29/766 X

*Primary Examiner*—Howard N. Goldberg
*Assistant Examiner*—Taylor J. Ross
*Attorney, Agent, or Firm*—Hill, Van Santen, Steadman & Simpson

[57] ABSTRACT

An apparatus for closing a succession of partly disengaged slide fastener coupling element chains with sliders mounted respectively thereon includes an element-engaging block assembly having a guide channel for constrictingly receiving a disengaged portion of each coupling element chain to close the same. The assembly includes a movable element-engaging block reciprocably movable toward and away from a stationary element-engaging block to selectively define therebetween the guide channel in timed relation to detection by a sensor of an element-free space between the successive chains and the slider.

9 Claims, 19 Drawing Figures

APPARATUS FOR CLOSING SLIDE FASTENER CHAINS HAVING SLIDERS

BACKGROUND OF THE INVENTION

1. Field of the Invention

The present invention relates generally to the manufacture of slide fasteners, and more particularly to an apparatus for automatically closing a plurality of longitudinally spaced slide fastener coupling element chains partly disengaged upon automatized threading of sliders on the respective chains through element-free spaces disposed between the successive chains.

2. Prior Problem

In the manufacture of slide fasteners, a pair of contiguous slide fastener stringers is partly separated or disengaged when a slider is threaded on each of a plurality of longitudinally spaced chains of interengaged coupling elements from an element-free portion disposed between the successive chains, and then the fastener stringers are severed at the element-free space to thereby produce a slide fastener of an individual length.

Due to the threading of slider, the coupling element chain is partly separated or disengaged and hence the slide fastener is flared at one end. The slide fastener having such flared end portion cannot easily be attached by sewing to a garment such as trousers. With the foregoing difficulty in view, there has been a desire for an apparatus capable of automatically closing the chains of partly disengaged coupling elements subsequent to threading of the sliders on the respective chains.

SUMMARY OF THE INVENTION

It is accordingly an object of the present invention to provide an apparatus for automatically closing a plurality of longitudinally spaced chains of partly disengaged slide fastener coupling elements with the sliders mounted respectively thereon.

According to the present invention, the foregoing and other objects of the present invention are attained by an apparatus for closing a succession of partly disengaged slide fastener coupling element chains with sliders mounted respectively thereon which includes an element-engaging block assembly having a guide channel for constrictingly receiving a disengaged portion of each coupling element chain to close the same. The assembly includes a movable element-engaging block reciprocably movable toward and away from a stationary element-engaging block to selectively define therebetween the guide channel in timed relation to detection by a sensor of an element-free space between the successive chains and the slider.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
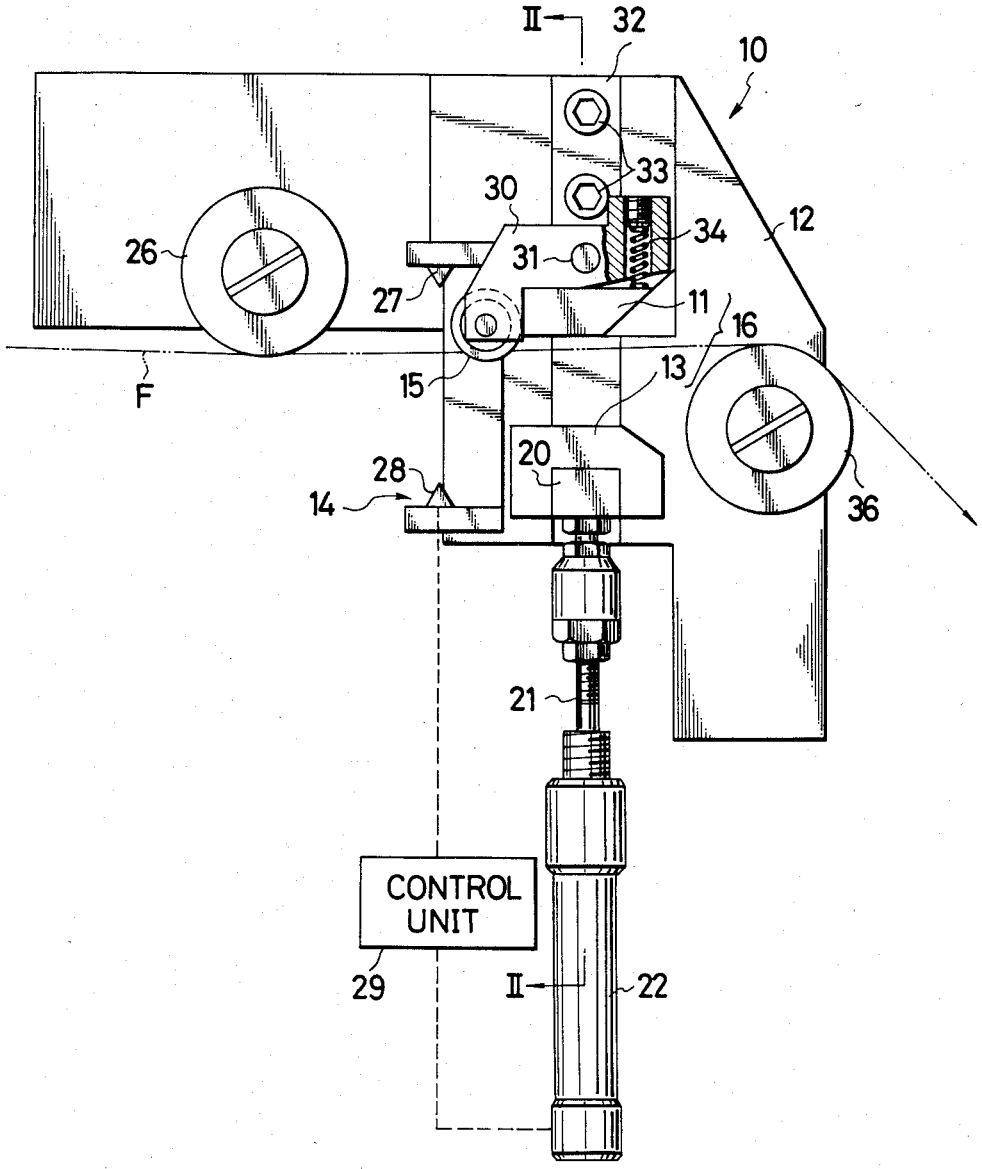
FIG. 1 is a schematic front elevational view, partly in cross section, of an apparatus embodying the present invention.

The principles of the present invention are particularly useful when embodied in a chain-closing apparatus such as shown in FIG. 1, generally indicated by the numeral 10.

The apparatus 10 generally comprises a stationary element-engaging block 11 fixedly mounted on a vertical support plate 12, a movable element block 13 slidably mounted on the support plate 12 and vertically movable toward and away from the stationary element-engaging block 11, a photoelectric sensor 14 disposed upstream of the stationary element-engaging block 11 and spanning the path of movement of a pair of continuous slide fastener stringers F to be processed on the apparatus 10, for detecting a disengaged portion of each coupling element chain or an element-free space disposed adjacent to the disengaged portion of the chain, and a spreading roller 15 disposed between the sensor 14 and the stationary element-engaging block 11 for spreading the disengaged portion of the chain or the element-free space to thereby assure reliable space sensing by the sensor 14. The stationary and movable element-engaging blocks 11, 13 jointly constitute an element engaging block assembly 16.

Figure 8A:
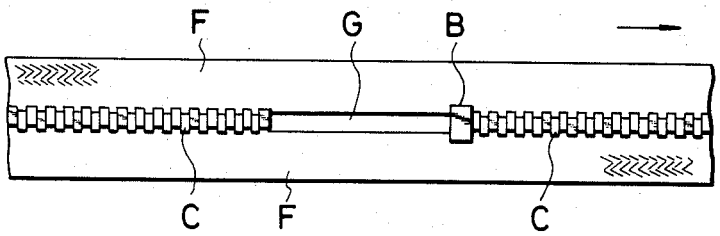
FIGS. 8A through 8C and 9A through 9C are fragmentary plan views of slide fastener stringers of different types illustrative of the manner in which a chain of coupling elements is closed by the apparatus of the present invention.
Figure 8B:
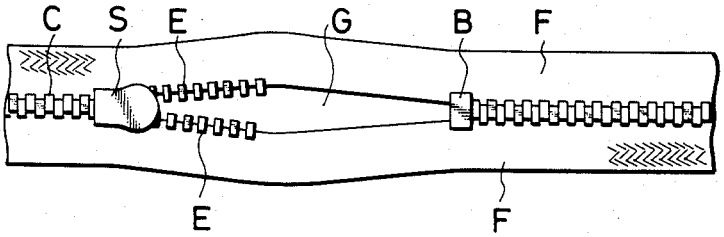

As shown in FIG. 8A, the slide fastener stringers F to be processed on the apparatus 10 include a plurality of longitudinally spaced chains C of two rows of interengaged coupling elements having a plurality of element-free gaps or spaces G (only one shown) disposed between the chains C. Each of the chains C has a bottom end stop B secured at one end (bottom end) thereof. Before being processed on the apparatus 10, a slider S is threaded on each chain C from the other end (top end) thereof through the adjacent element-free space G while a rear end of the slider S is facing away from the bottom end stop B of the preceding chain C. Due to this threading of slider, the rows of coupling elements E of the chain C are separated or disengaged from the top ends thereof, as shown in FIG. 8B.

Figure 9A:
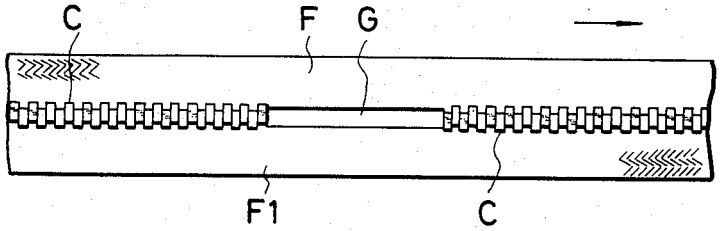
Figure 9B:
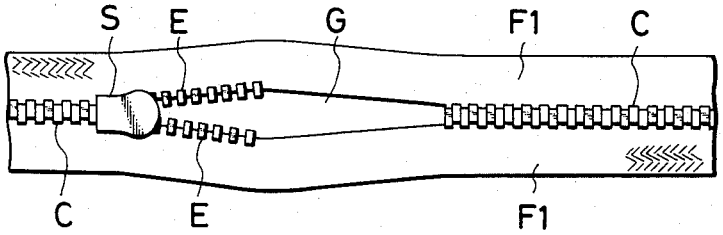
Figure 9C:
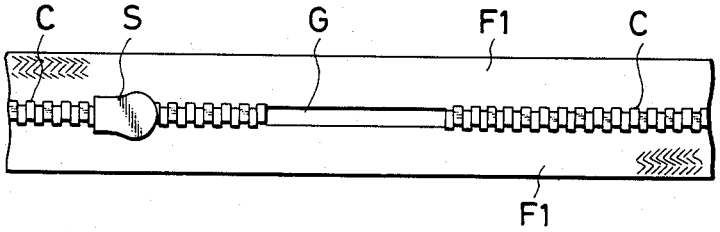
Figure 10A:
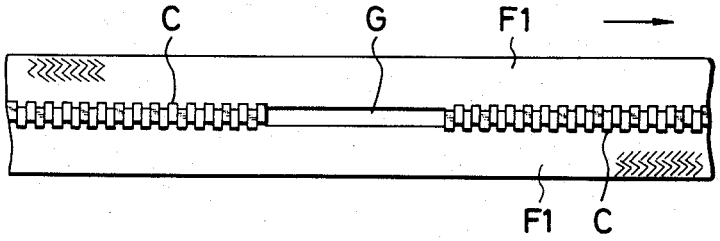
FIGS. 10A through 10C and 11A through 11C are views similar to FIGS. 9A–9C, but showing different modes of chain-closing operation.
Figure 10B:
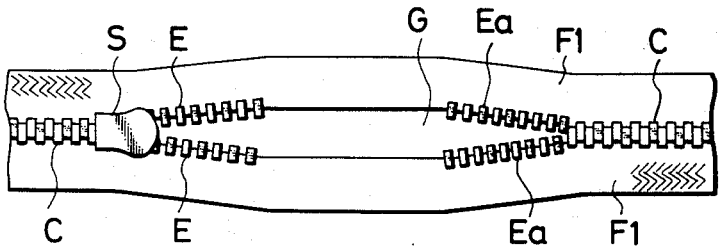
Figure 10C:
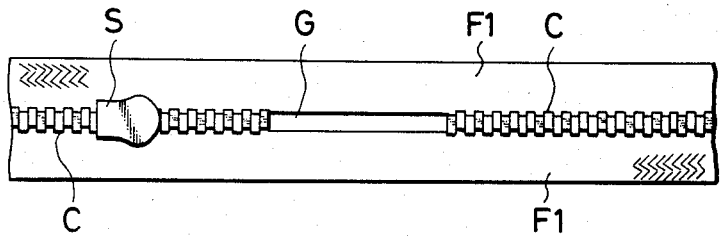
Figure 11A:
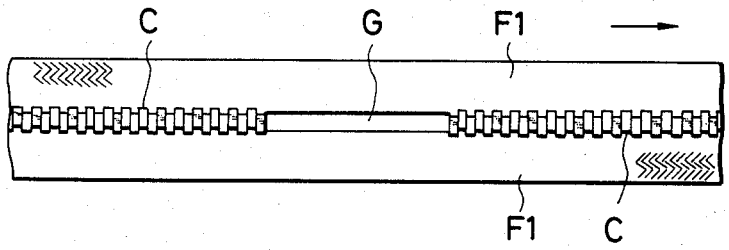
Figure 11B:
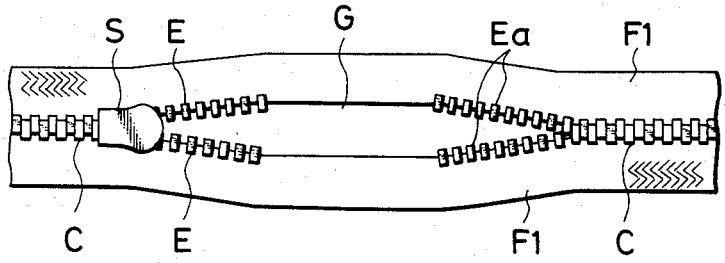

The apparatus 10 of the present invention is also effectively operative to process a pair of slide fastener stringers F1 such as shown in FIGS. 9A, 10A and 11A. The slide fastener stringers F1 are the same as the slide fastener stringers F of FIG. 8A with the exception that a bottom end stop is not mounted on each chain C of coupling elements. The chain C is therefore separable from either one or both ends as shown in FIGS. 9B, 10B and 11B when a slider S is threaded on the chain C.

Figure 3:
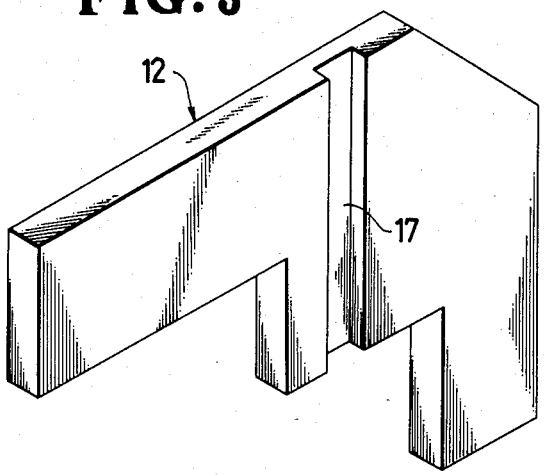
FIG. 3 is a perspective view of a support plate of the apparatus shown in FIG. 1.

As shown in FIG. 3, the support plate 12 has a vertical guide groove 17 extending therethrough.

Figure 4:
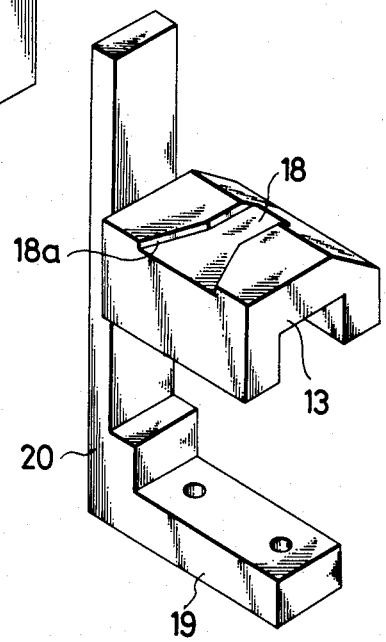
FIG. 4 is an enlarged exploded perspective view of a movable element-engaging block assembly of the apparatus shown in FIG. 1.

The movable element-engaging block 13 includes, as shown in FIG. 4, a horizontal guide groove 18 defined in its upper surface for constrictingly receiving the partly disengaged coupling element chains to close the same in the manner as described later. The guide groove 18 has a width slightly larger than the width of the chains C of interengaged coupling elements. The guide groove 18 includes a flared inlet portion 18*a* for easy entry of the coupling element chains C into the guide groove 18. The movable element-engaging block 13 is secured by a pair of screws (FIG. 2) to a horizontal arm 19 of an L-shaped support bracket 20 slidably received in the vertical groove 17 in the support plate 12. Connected to the horizontal arm 19 is a piston rod 21 of an air cylinder 22 which is actuated to reciprocate the bracket 20 along the vertical guide groove 17, thereby moving the movable element-engaging block 13 toward and away from the stationary element-engaging block 11.

Figure 5:
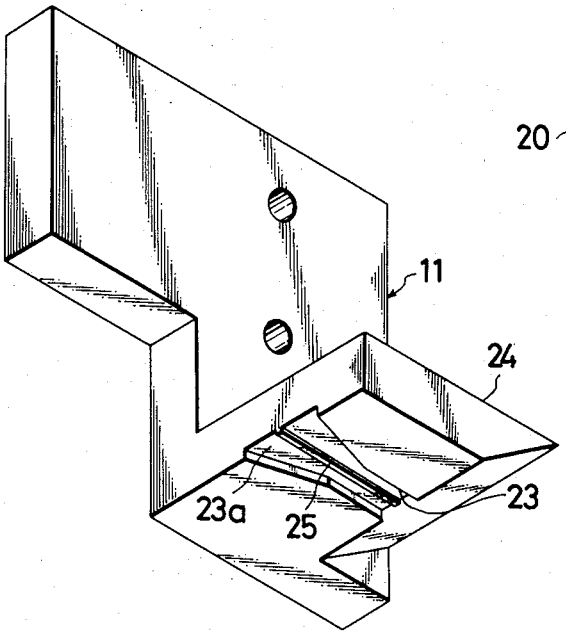
FIG. 5 is an enlarged perspective view of a stationary element-engaging block of the apparatus shown in FIG. 1.
Figure 6:
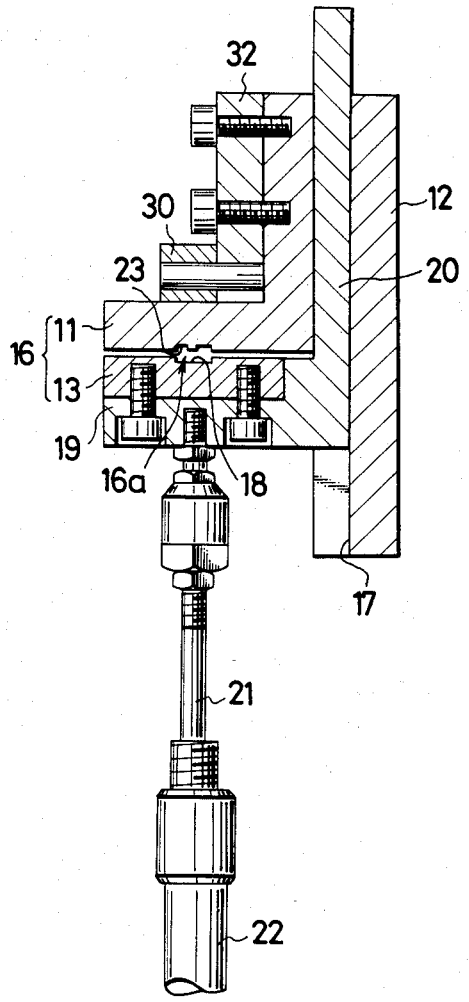
FIG. 6 is a view similar to FIG. 2, showing the movable element-engaging block held in its upper working position.

The stationary element-engaging block 11 has an L-shape as shown in FIG. 5 and includes a guide groove 23 which is defined in the underside of a horizontal arm 24 of the stationary element-engaging block 11 in confronting relation to the guide groove 18 in the movable element-engaging block 13. The guide groove 23 has the same shape as the guide groove 18 and hence includes a flared inlet portion 23*a*. When the movable element-engaging block 13 is moved upwardly to its upper working position shown in FIG. 6, the stationary and movable element-engaging blocks 11, 13 jointly constitute the element-engaging block assembly 16. The assembly 16 has a guide channel 16*a* formed jointly by the guide grooves 18, 23 of the movable and stationary element-engaging blocks 13, 11 so that it functions as a slide fastener slider for closing the partly disengaged coupling element chains C. The stationary element-engaging block 11 further includes a guide ridge 25 disposed centrally in and extending longitudinally through the guide groove 23 for restricting lateral movement or wobbling of the coupling element chains C as they pass through the guide channel 16*a* in the element-engaging block assembly 16.

The photoelectric sensor 16 is disposed between the element-engaging block assembly 16 and a tension roller 26 rotatably mounted on the vertical support plate 12 at a position upstream of the element-engaging block assembly 16. The tension roller 26 is held in contact with the slider fastener stringers F to exert a tension on the latter while the fastener stringers F are fed along the path. The photoelectric sensor 14 includes a light projector 27 and a photoelectric cell 28 disposed on opposite side of the path of movement of the fastener stringers F in confronting relation to each other. The photoelectric cell 28 is connected, for energization and de-energization, in circuit with the cylinder 22 through a control unit 29. When an element-free space G or a disengaged portion Ea (FIG. 10B) of the coupling element chain C arrives at the photoelectric sensor 14 and opens the light beam path from the light projector 27, the photoelectric cell 28 sends an electric signal to the control unit 29 which in turn sends an output signal to the cylinder 22 to cause the latter to extend its piston rod 21. Consequently, the movable element-engaging block 13 is moved upwardly toward the stationary element-engaging block 11. When the slider S arrives at the photoelectric sensor 14 and blocks the light beam path from the light projector 27, the photoelectric cell 28 sends an electric signal to the control unit 29 which at a predetermined interval of time after receipt of the electric signal, sends an output signal to the cylinder 22 to cause the latter to reverse its mode of operation. That is, the cylinder is de-energized to lower the movable element-engaging block 13. The light beam projected from the light projector 27 may be a laser beam.

Figure 2:
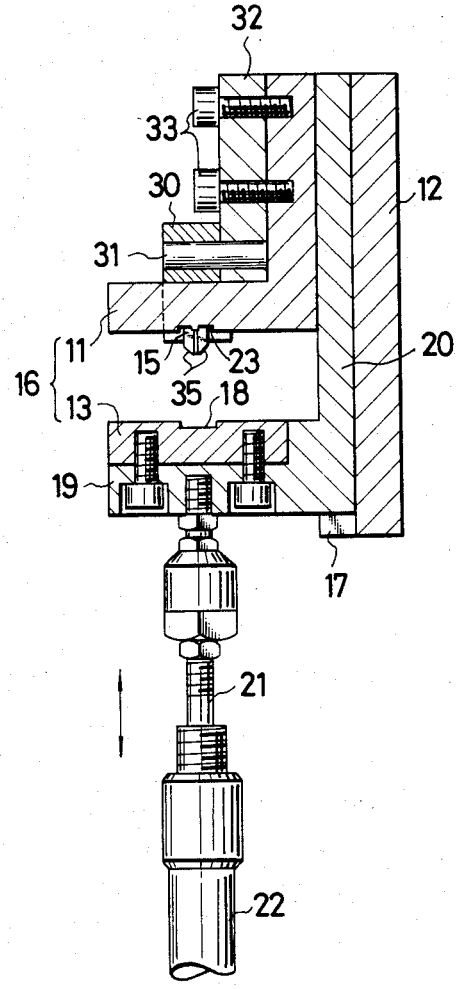
FIG. 2 is a cross-sectional view taken along line II—II of FIG. 1.

The spreading roller 15 is rotatably mounted on a lower end of an inverted L-shaped lever 30. The lever 30 is pivotably connected by a pin 31 to a vertical elongate member 32 secured by a pair of screws 33, 33 to the stationary element-engaging block 11. A compression coil spring 34 acts between the stationary element-engaging block 11 and the lever 30 to turn the latter about the pin 31 in the counterclockwise direction in FIG. 1, thereby urging the spreading roller 15 downwards. The spreading roller 15 has a tapered outer peripheral edge 35 as shown in FIG. 2.

Designated by the numeral 36 (FIG. 1) is an idler roller for guiding the slide fastener stringers F as they are fed through the apparatus 10 by a non-illustrated feed means.

The apparatus 10 of the foregoing construction operates as follows. The slide fastener stringers F, F shown in FIG. 8B are introduced into the apparatus 10 and fed longitudinally along the path at a first or high speed until an element-free space G between adjacent two chains C is detected by the photoelectric sensor 14. During that time, the spring-biased spreading roller 15 is held in rolling engagement with two rows of interengaged coupling elements of the preceding chain C, and then is urged into the element-free space G under the force of the spring 34, thereby spreading the element-free space G. With the element-free space G thus spread, detection of the same by the photoelectric sensor 14 can be achieved reliably. Upon detection of the element-free space G, the photoelectric cell 28 of the sensor 14 sends an electric signal to the control unit 29 which in turn sends an output signal to the non-illustrated feed means to cause the same to operate in a different mode in which the slide fastener stringers F, F are fed at a second or low speed. At the same time, the control unit 29 sends an output signal to the air cylinder 22 to energize the same, whereupon the movable element-engaging block 13 is moved upwardly from a lower stand-by position of FIG. 2 to an upper working position of FIG. 6. The stationary and movable element-engaging blocks 11, 13 now constitute a element-engaging block assembly 16 which has the same function as a slide fastener slider. While the slide fastener stringer F, F are being continuously fed at the low spaced, a disengaged portion E of the next following chain C is introduced into the guide grooves 18, 23 in the element-engaging block assembly 16 and then coupling elements of the disengaged chain portion E are brought into inter-digitating engagement with each other.

Figure 7:
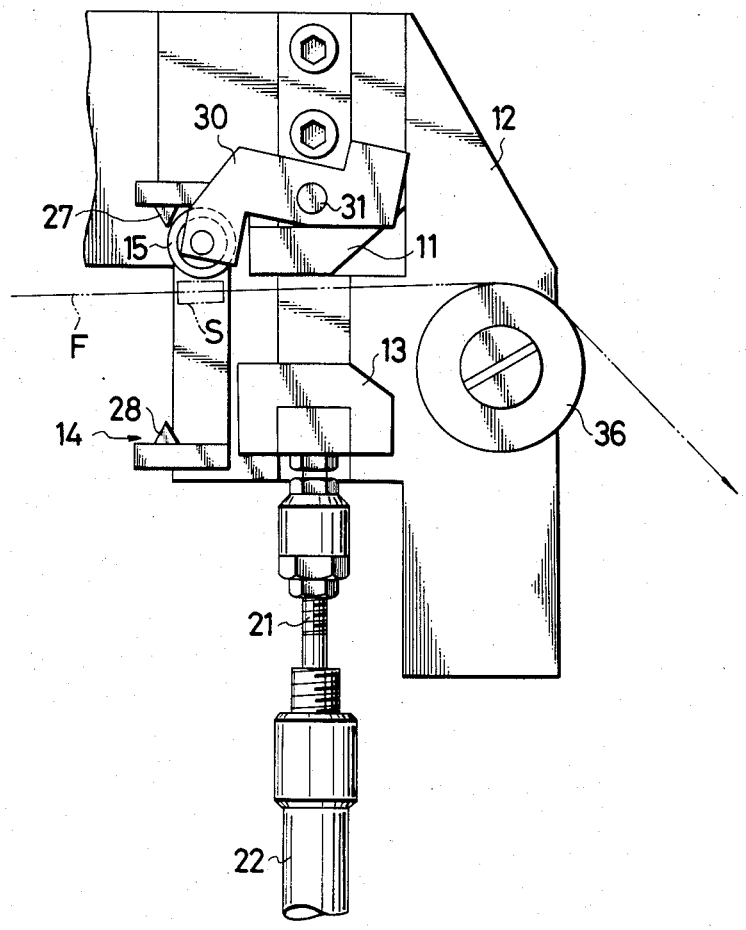
FIG. 7 is a view similar to FIG. 1, illustrative of the operation of a spreading roller of the apparatus.
Figure 8C:
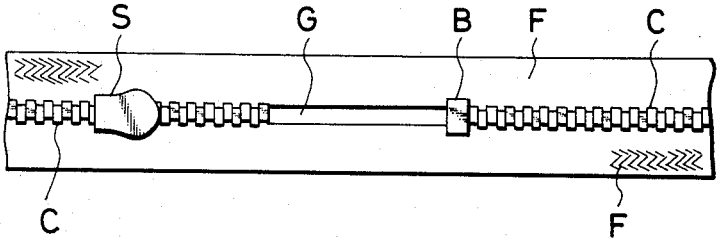

As the slide fastener stringers F, F are further advanced, a slider S on the chain C arrives at the photoelectric sensor 14 and blocks the light beam path from the light projector 27. The photoelectric cell 28 then sends an electric signal to the control unit 29 to cause it to set a time switch (not shown) in the control unit 29. The control unit 29, at a predetermined interval of time after setting of its time switch, sends an output signal to the air cylinder 22 to de-energize the same. That is, upon its de-energization, the cylinder 22 retracts its piston rod 21 to lower the movable element-engaging block 13 to its lower stand-by position shown in FIG. 2. At the same time, the control unit 29 also sends an output signal to the feed means to cause the same to reverse its mode of stringer feeding operation. The slide fastener stringers F, F are fed again at the high speed. The time interval is selected such that coupling engagement of the disengaged portion E of the chain C (FIG. 8B) continues after detection of the slider S by the sensor 14 until the chain C is fully closed, as shown in FIG. 8C after the slider S on the chain C has been detected by the photoelectric sensor 14. As the slide fastener stringers F, F are further advanced after the full closure of the chain C, the slider S abuts against the spreading roller 15, which then is urged upwardly against the force of the compression coil spring 34 (FIG. 7), and finally passes through the element-engaging block assembly 16.

Thus, the foregoing cycle of operation of the apparatus 10 can be repeated automatically until all the partly separated coupling element chains C are closed. It appears that since individual slide fasteners produced by severing the slide fastener stringers F, F, at the element-free spaces G have respective fully closed coupling element chains C, they can be easily attached by sewing to the garment fabrics.

In case where the slide fastener stringers F1, F1 shown in FIG. 10B are to be closed, the chain-closing apparatus 10 operates in the same manner as it has done to close the slide fastener stringers F, F shown in FIG. 8B.

When the slide fastener stringers F1, F1 shown in FIG. 10B are to be closed, the cylinder 22 is energized to move the movable element-engaging block 13 toward its upper operating position (FIG. 6) upon arrival of a disengaged portion Ea of the preceding coupling element chain C at the photoelectric sensor 14. As the slide fastener stringer F1, F1 are fed forwardly, the spreading roller 15 projects into the disengaged chain portion Ea and spreads the same to assure reliable detection of the disengaged chain portion Ea by the photoelectric sensor 14. A continuous advancing movement of the slide fastener stringers F1, F1 causes the disengaged portion Ea of the preceding chain C and a disengaged portion E of the next following chain to be closed as they move through the guide channel 16*a* in the element-engaging block assembly 16. Other operational steps of the apparatus 10 are the same as the apparatus 10 has done in closing the slide fastener stringers F, F and F1, F1 shown respectively in FIGS. 8B and 9B and no description is necessary.

Figure 11C:
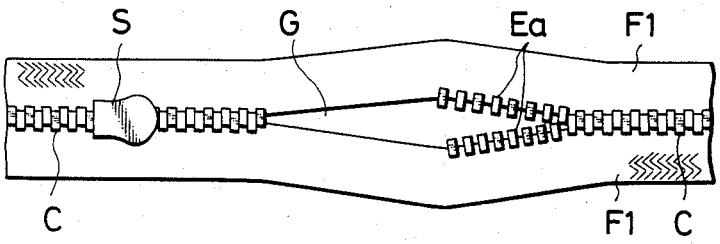

The apparatus 10 of the present invention is also effectively operative to close the slide fastener stringers F1, F1 in the manner as shown in FIGS. 11B and 11C. In this instance, the cylinder 22 is actuated to lift the movable element-engaging block 13 upon expiration of a predetermined interval of time after detection by the senser 14 of a disengaged portion Ea of the preceding coupling element chain C. The time interval is selected such that the disengaged chain portion Ea has advanced beyond the element-engaging block assembly 16 after its detection by the sensor 14. This selection of the time interval is achieved by a time switch of the control unit 29. As the slide fastener stringers F1, F1 are fed forwardly while the movable element-engaging block 13 is being held in the upper working position, the disengaged portion E of the next following chain C is closed, as shown in FIG. 11C. The disengaged portion Ea of the preceding chain C still remains unclosed.

Obviously, many modefications and variations of the present invention are possible in the light of the above teachings. It is therefore to be understood that within the scope of the appended claims, the invention may be practiced otherwise than as specifically described.

What is claimed is:

1. An apparatus for closing a pair of slide fastener stringers including a plurality of longitudinally spaced chains of partly engaged coupling elements with sliders mounted respectively thereon, there being an element-free space between successive chains, each chain having a disengaged portion extending between a top end thereof and the slider mounted thereon, said apparatus comprising:

(a) a stationary element-engaging block disposed on one side of a path of movement of the coupling element chains and having a first guide groove facing toward the path;

(b) a movable element-engaging block disposed on the other side of the path and having a second guide groove facing toward said first guide groove, said movable element-engaging block being reciprocative toward and away from the stationary element-engaging block for causing said first and second guide grooves to selectively form a guide channel for constrictingly receiving therein the disengaged portion of each chain to close the same;

(c) a sensor disposed upstream of said stationary element-engaging block for detecting the element-free space and the slider mounted on the chain next following the element-space; and (d) an actuator under the control of said sensor and operatively connected to said movable element-engaging block for reciprocating the latter.

2. An apparatus according to claim 1, further including a spring-biased spreading roller disposed upstream of said stationary element-engaging block for spreading the element-free space and the disengaged chain portion.

3. An apparatus according to claim 2, said spreading roller being disposed between said stationary element-engaging block and said sensor.

4. An apparatus according to claim 1, said sensor being of the photo-electric type and spanning the path of movement of the coupling element chains.

5. An apparatus according to claim 1, each of said first and second guide groove having a flared inlet portion.

6. An apparatus according to claim 1, said stationary element-engaging block including a guide ridge disposed centrally in and extending along said first guide groove.

7. An apparatus according to claim 1, further including a control unit responsive to said sensor and connected with said actuator for moving said movable element-engaging block away from said stationary element-engaging block at a predetermined interval of time after detection of each slider by said sensor.

8. An apparatus according to claim 7, for use with a pair of continuous slide fastener stringers of the type wherein each coupling element chain includes a disengaged top portion extending above a slider mounted thereon and a disengaged bottom portion at a bottom end thereof, said sensor detecting the disengaged bottom portion of a coupling element chain and the slider on the next following chain, said control unit being operative to further control operation of said actuator for moving said movable element-engaging block toward said stationary element-engaging block in response to detection of the disengaged bottom portion by said sensor.

9. An apparatus according to claim 7, for use with a pair of continuous slide fastener stringers of the type wherein each coupling element chain includes a disengaged top portion extending above a slider mounted thereon and a disengaged bottom portion at a bottom end thereof, said sensor detecting the disengaged bottom portion of a coupling element chain and the slider on the next following chain, said control unit being operative to further control operation of said actuator for moving said movable element-engaging block toward said stationary element-engaging block at a predetermined interval of time after detection of the disengaged bottom portion by said sensor.

* * * * *